US006802914B2

(12) United States Patent
Jager

(10) Patent No.: US 6,802,914 B2
(45) Date of Patent: Oct. 12, 2004

(54) STRESS RELIEVED GRINDING BALL HAVING HARD OUTER SHELL

(75) Inventor: Christian Albert Jager, Edmonton (CA)

(73) Assignee: Stelco Inc., Hamilton (CA)

( * ) Notice: Subject to any disclaimer, the term of this patent is extended or adjusted under 35 U.S.C. 154(b) by 0 days.

(21) Appl. No.: 10/607,805

(22) Filed: Jun. 27, 2003

(65) Prior Publication Data

US 2004/0118485 A1 Jun. 24, 2004

Related U.S. Application Data

(62) Division of application No. 09/758,016, filed on Jan. 10, 2001, now Pat. No. 6,632,303.
(60) Provisional application No. 60/175,231, filed on Jan. 10, 2000.

(51) Int. Cl.[7] ..... C22C 38/02; C22C 38/04

(52) U.S. Cl. ..... 148/320; 148/333; 148/334
(58) Field of Search ..... 148/320, 333, 148/334

(56) References Cited

U.S. PATENT DOCUMENTS 4,221,612 A * 9/1980 Thome ..... 148/616

FOREIGN PATENT DOCUMENTS

| | | |
|---|---|---|
| CA | 399994 | 10/1941 |
| CA | 433070 | 2/1946 |

* cited by examiner

*Primary Examiner*—Deborah Yee
(74) *Attorney, Agent, or Firm*—Alston & Bird LLP

(57) ABSTRACT

A grinding ball having a 55 to 65 Rockwell C hardened outer shell of tempered martensite is adapted for use in heavy duty grinding environments. The ball is stress relieved to stabilize the ball against break up and/or spalling.

8 Claims, 4 Drawing Sheets

STRESS RELIEVED GRINDING BALL HAVING HARD OUTER SHELL

CROSS-REFERENCE TO RELATED APPLICATION

This application is a divisional of U.S. application Ser. No. 09/758,016, filed Jan. 10, 2001 now U.S. Pat. No. 6,632,303, issued Oct. 14, 2003 claiming the benefit of provisional U.S. Application No. 60/175,231, filed Jan. 10, 2000.

FIELD OF THE INVENTION

This invention relates to stress relieved grinding balls to enhance durability of the balls, particularly in heavy duty grinding environments.

BACKGROUND OF THE INVENTION

Various technologies are available for manufacturing grinding balls for use in grinding mills, such as in ore crushing, stone crushing and the like. Grinding balls are usually 2.5 to 14 centimeters in diameter depending upon the size of the grinding mill. Balls can be cast from iron using a combination of alloys to develop the desired hard, wear resistant surface. However, the high cost of casting and the high cost of alloys required by this process usually make it prohibitively expensive. More commonly, balls are forged from steel with a selected chemistry and heat treated to give the best combination of wear rate and toughness. It has been found that the useful life of a grinding ball may be improved if it has a hard, tough outer shell usually of martensitic microstructure. The high hardness is required to reduce the erosive wear prevalent in grinding applications. The shell toughness is required to prevent the loss of pieces of the ball by spalling. In addition to shell toughness, the ball requires a core toughness that keeps the entire ball from breaking, particularly in the case of larger balls. Examples of such grinding ball technology are described in Canadian patents 399,994 issued Oct. 14, 1941 and 433,070 issued Feb. 12, 1946.

The ball toughness is directed towards preventing breakage by the ball stresses. This is particularly true with larger balls, usually larger than 7 to 8 cm in diameter. A moderate level of compressive stress in the outer shell which is balanced by tensile stresses in the core help hold the relatively brittle ball steel together and prevent ball breakage. In addition, moderate compressive shell stresses help prevent spalling. High ball stresses, which exceed the tensile strength of the core or the compressive strength of the shell, cause breakage or spalling. Low ball stresses, which allow the surface of the ball to go into tension, can also cause breakage.

Accordingly, this invention provides grinding balls that have the desired wearability and have the desired durability in grinding environments. The advantage of this invention has been surprisingly provided by way of a stress relieving technique for already tempered grinding balls, particularly for larger balls having a hardness of an outer martensitic shell of a hardness greater than 55 and usually 60 to 65 Rockwell C and an inner pearlitic core. Although stress relieving techniques have been used in conjunction with tool steels, this is generally understood by those skilled in the art to perform different functions in view of the high alloy contents and high carbon contents of tool steels. The purpose of stress relieving is to modify the structure of the tool steel so that, for example with tool steels, stress relieving is conducted at relatively high temperatures usually around 500° C. In view of the high alloy content, it is generally understood that stress relieving at these high temperatures brings about a change in the characteristic of the tool steel. Conversely, it is generally understood that tempering of carbon and low alloy steel products after the first temper does not bring about any significant changes in the physical characteristics of the product.

In the ore grinding field, applicant has developed a technique for stress relieving grinding rods which present unique heat treating problems because of their overall length usually greater than 10 feet. Quenching of such rods can be achieved in a special quenching chamber where high speed flows of quenching liquid, preferably water, passes along the length of the rod to achieve very rapid quenching of the rod. This type of quenching step greatly enhances the Rockwell hardness of the material. Applicant has found that, stress relieving such rapidly quenched rods, greatly reduces the potential of rod break-up, increases rod toughness and durability of the rod and provides prolonged rod life in a grinding environment.

SUMMARY OF THE INVENTION

In accordance with an aspect of the invention, a grinding ball is provided which has a hardened outer shell of tempered martensite wherein the ball has been stress relieved to stabilize the ball against break up and/or spalling.

In accordance with another aspect of the invention, a process for making a grinding ball having a hardened section of tempered martensite wherein said ball has been stress relieved to stabilize said ball against break up and/or spalling, the process comprising i) reheating a tempered grinding ball having a hardened section of tempered martensite to its previous equalization temperature of its earlier tempering process;

ii) holding the grinding ball at the equalization temperature for a period of time sufficient to relieve partially compressive stresses in the tempered martensite section to develop an outer stress relieved martensitic shell and an inner non-stress relieved martensitic section; and iii) allowing the reheated stress relieved ball to cool.

In accordance with another aspect of the invention, a grinding ball has a hardened section of tempered martensite wherein the ball has been stress relieved to stabilize the ball against break up and/or spalling by developing an outer stress relieved martensitic shell.

BRIEF DESCRIPTION OF THE DRAWINGS

Aspects of the manufacturing process for making tempered grinding balls are described with respect to the drawing wherein.

DETAILED DESCRIPTION OF THE PREFERRED EMBODIMENTS

Figure 1:
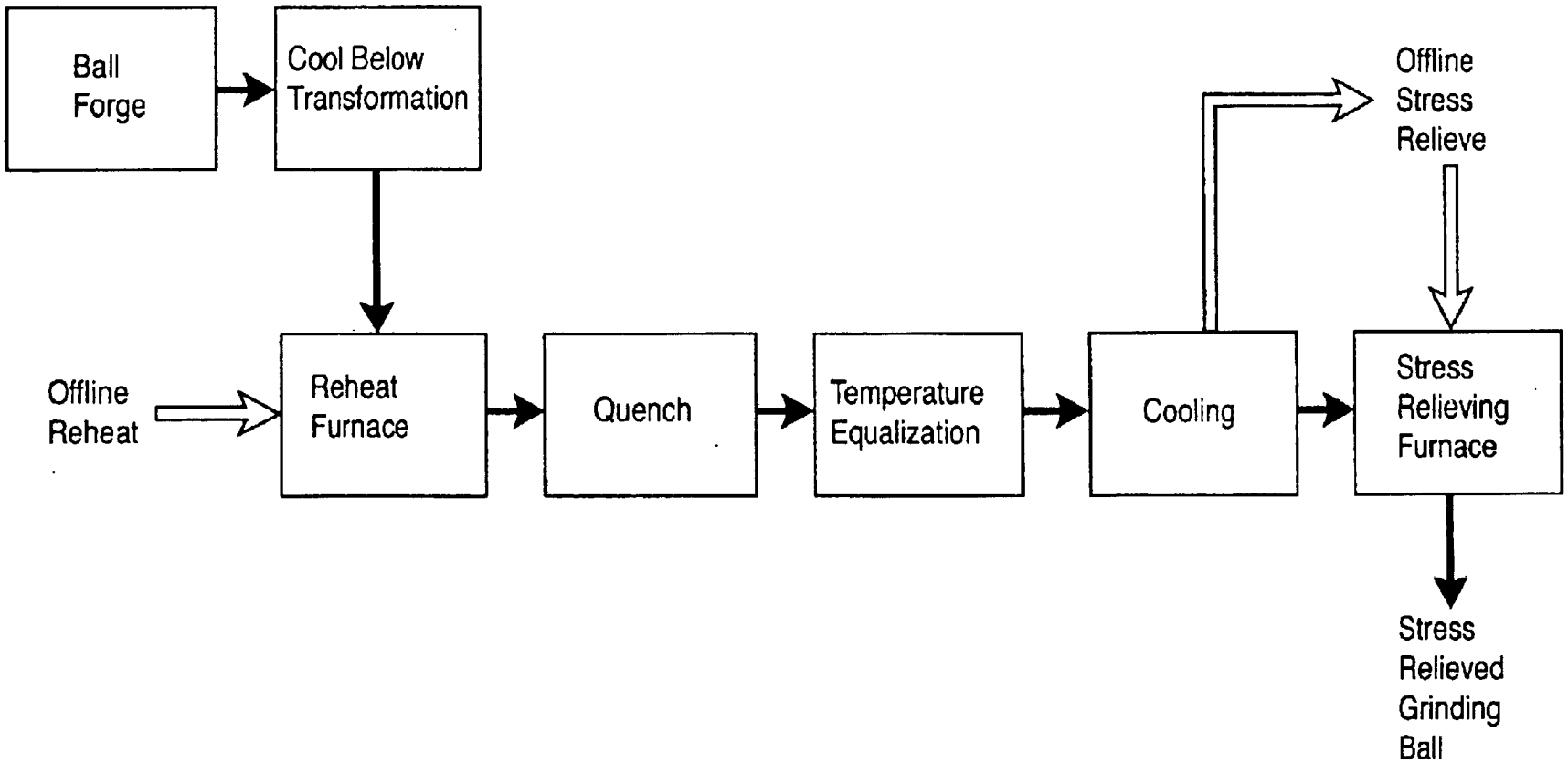
FIG. 1 is a schematic of a heat treating line for heat treating and self-tempering steel balls to form grinding balls followed by stress relieve.

Applicant has found that the durability of the long wearing, hard outer shell grinding balls can be surprisingly enhanced by carrying out a mild stress relieve on the tempered ball. This advance in grinding ball technology is particularly important in supplying balls with enhanced performance, particularly in heavy duty grinding environments. The stress relieve of the tempered ball applies to a broad range of chemistries for the ball stock as well as the types of crystalline structure for the ball core and ball shell. Although it is not fully understood why the stress relieving brings about this unexpected enhancement in durability, it is thought that the stress relieve step somehow reduces the stresses in the shell and core in a manner which considerably increases resistance to break up and/or spalling. Usually, stress relieving of steel reduces the hardness characteristic. This, of course, would not be a benefit when designing grinding balls to have harder outer shells. It has been found, however, that tempered grinding balls, when stress relieved at or about their equalization temperature, for a period of time sufficient to reduce circumferential compressive stresses in the outer shell do not at the same time have any appreciable effect on the shell hardness. The period of time for reheating and holding the tempered grinding ball at the equalization temperature is sufficient to reduce the compressive stresses in the outer shell where mild form of stress relieve stabilizes the ball against break up. In larger balls, usually greater than 7 to 8 cm in diameter, such break up is caused by the balancing tensile stresses in the pearlitic core exceeding the tensile strength of the core.

Although it was generally understood that reheating tempered steel to its equalization temperature would not have any effect on the stresses in the steel item, it has been surprisingly found that such reheat for the grinding ball does relieve stresses in the outer shell without appreciably reducing hardness in the outer shell. The equalization temperature is the temperature to which the ball reheats to after quench in its first or primary heat treatment where the temperature is essentially uniform across the section of the ball after the ball has equalized in temperature.

Now that it has been realized that a secondary heat treatment for stress relieving the ball appreciably increases durability and toughness of the ball, a superior product is provided for heavy duty grinding environments. It is thought that balls with very hard outer shells inherently had very high circumferential compressive stresses in the outer shell which result in very high core tension. It has now been found that reducing the compressive forces in the outer shell can, at least in larger balls, correspondingly reduced tension on the core. Such reduction in stresses stabilizes the ball against break up which would normally be caused by high circumferential compressive stresses exceeding the tensile strength of the core. Depending upon the type of chemistry and the type of heat treating to produce a grinding ball, the equalization temperature for the stress relieve process will vary, but only to the extent that one skilled in the art, based on the following examples of chemistry and various stress relieve times, can readily determine.

In accordance with preferred aspects of the invention, the harder outer martensitic shell can be provided by selecting the amount of carbon used in the steel alloy, to be in the range of 0.7 to 1.3% by weight. This range of carbon can achieve an outer shell hardness greater than 55 Rockwell C and up to 65 Rockwell C depending upon the manner of the primary heat treatment. Manganese is included at a level in the range of about 0.6 to 1.0% by weight and silicon is included at a level of about 0.1 to 0.4% by weight. In order to achieve an annular uniform layer of martensite of substantial depth, significant amounts of chromium and/or molybdenum are used. The amount of chromium ranges from residual levels up to 1.0% by weight. Molybdenum in the ball ranges from residual levels up to 0.5% by weight.

The above broad ranges for the chemistry of the ball stock provides a host of combinations which achieve desired ranges in the hardness of the outer martensitic shell and hardness of the ball core. Such variation in the ball characteristics provide for a variety of applications including light, medium and heavy duty applications. The advantage of the second tempering of the ball allows one to achieve uses for the balls in heavy duty grinding applications while implementing a less expensive chemistry.

In accordance with an aspect of the invention, a preferred chemistry for the ball is as follows:

| | |
|---|---|
| carbon | .70–1.30% by weight |
| manganese | .60–1.00% by weight |
| silicon | .10–.40% by weight |
| chromium | .01–1.00% by weight |
| molybdenum | .01–.50% by weight |

the balance being essentially iron.

At the same time such chemistry provides an outer martensitic shell having a hardness greater than 55 Rockwell C and up to 65 Rockwell C and greater. By virtue of the selected chemistry and a preferred type of heat treatment, the martensitic shell is of a uniform annular thickness preferably greater than about 2.5 cm and up to or greater than 3.8 cm or more in depth, depending on ball diameter. For example, with smaller ball sizes, usually less than 7 to 8 cm in diameter, there will be little if any hardness profile in the tempered ball before stress relieve. The entire section of the ball is most likely martensitic with little if any pearlitic core. Hence a stress relieving of the small ball results in an outer stress relieved martensitic shell and inner martensitic section which may extend to ball centre. There is no inner balancing pearlitic core. It might be suggested, based on the aforementioned prior art, that there is no benefit to stress relieving the martensitic ball section, particularly for smaller balls. Quite surprisingly, however, applicant has discovered that stress relieving the tempered small balls leads to the significant benefit of less spalling of smaller balls. On average, it is generally understood that smaller tempered balls do not suffer from ball break-ups to the extent that larger balls suffer from break up.

With larger balls, usually greater than 7 to 8 cm in diameter, tempered balls have a hardness profile in section. The profile ranges from a hard outer martensitic shell to a soft pearlitic core. The transition zone from the hard martensitic shell to pearlitic core usually includes some bainite. It is generally understood, when defining for example the depth of the martensitic shell, in view of their being a transition zone, the shell has a boundary defined by the circumferential zone which comprises about 50% by weight martensite. Such boundary is identified with respect to the following discussion of FIG. 3. Stress relieving of the larger balls not only reduces the spalling problems, but as well minimizes the problem of the aforementioned ball break up due to an imbalance of stresses across the hardness profile. The stress relieved ball with the stress relieved outer martensitic shell greatly reduces ball break up. This is believed to be due at least in part to a balancing of the compressive stresses in the martensitic shell with the tensile stresses in the pearlitic core.

A representative heat treating line for reheating steel balls, quenching steel balls and subsequently stress relieving balls is shown in FIG. 1. Balls are forged for this process using either upset or rotary forging techniques. They can be heat treated either after air cooling below the transformation temperature or after complete cooling to room temperature. Transformation temperature for balls of the composition used in this process is about 725° C. and cooling temperatures are typically 500–600° C. The purpose of this cooling is to provide a finer grain size and a tougher ball than may be obtained by quenching directly the ball as it emerges at the forging temperature.

The air cooled or the cold balls are reheated above the transformation temperature in a reheat furnace. For steels of the composition used in this process, reheat temperatures range from 750 to 925° C. The uniformly reheated balls are discharged from the furnace into a quench system which rapidly removes heat from the balls to develop a hard annular layer of martensite of uniform depth. The ball quench time is selected such that soak back temperature after leaving the quench system, which is the equalization temperature, is less than 300° C. and greater than 100° C.

The process of FIG. 1 may include a stress relieve station directly after temperature equalization. Alternatively, the stress relief may be carried out at another location, off-line from this processing line. Preferably, the tempered balls are stress relieved within a day or two of the tempering process. It is understood that as the balls cool down the compressive stresses in the outer tempered martensitic shell should not exceed the balancing tensile strength of the core. If there is a problem with the balls breaking up, then it is understood that the balls should be stress relieved directly after cooling which would be within about 1 to 2 hours of the quenching and temperature equalization processes.

At the stress relieve station, the balls, if they are still hot from the primary heat treatment process, are first cooled to ambient temperature and then reheated to the equalization temperature of the primary or earlier tempering process. In accordance with this particular embodiment for the hardened ball, the equalization temperature is less than 250° C. and greater than 100° C. which is the same as the soak back temperature of the balls when they exit the quench vessel. The balls are held at the equalization temperature for a limited period of time sufficient to reduce internal circumferential compressive stresses in the hard martensitic shell. This limited period of treatment in reducing the compressive stresses in the martensitic shell does not, at the same time, appreciably affect the hardness of the outer shell. Ideally, the hardness should not drop at all. The process of this invention achieves the desired degree of stress relieve under less controlled conditions for a bulk number of balls. There may, however, be a slight drop in hardness for this process, but only in the range of 1 or 3 points of Rockwell hardness. It is also understood that in circumstances where balls with a lower degree of hardness are required, but yet of significant durability, a modification to the stress relieve process may also be useful in providing a much greater degree of stress relieve in the outer shell and hence a greater drop in hardness. For example, with grinding balls having martensitic shells of a hardness in the range of 55 to 60 Rockwell C, the stress relieve process may be used if warranted to enhance further the toughness and durability of the ball by further reducing the circumferential compressive stresses in the martensitic shell by prolonged treatment.

In order to minimize the effects that hydrogen has on the ball during tempering, it is understood that the bars which are forged into balls or the balls themselves may be subjected to a degassing step. This step minimizes hydrogen build-up in the ball to enhance crack resistance of the ball during heat treatment and during use. With the preferred chemistries and preferred tempering process, it has been found that equalization temperatures are normally in the range of about 100° C. to about 300° C. For chemistries which produce a hardness of 60 to 65, the preferred equalization temperature is about 150° C. The tempered and cooled ball is heated and after it uniformly attains the equalization temperature, it is held at the equalization temperature for only about 60 minutes. During this period of time, the compressive stresses in the martensitic shell are considerably reduced. After this predetermined period of reheat for purposes of stress relieve, the balls are air cooled.

Figure 2:
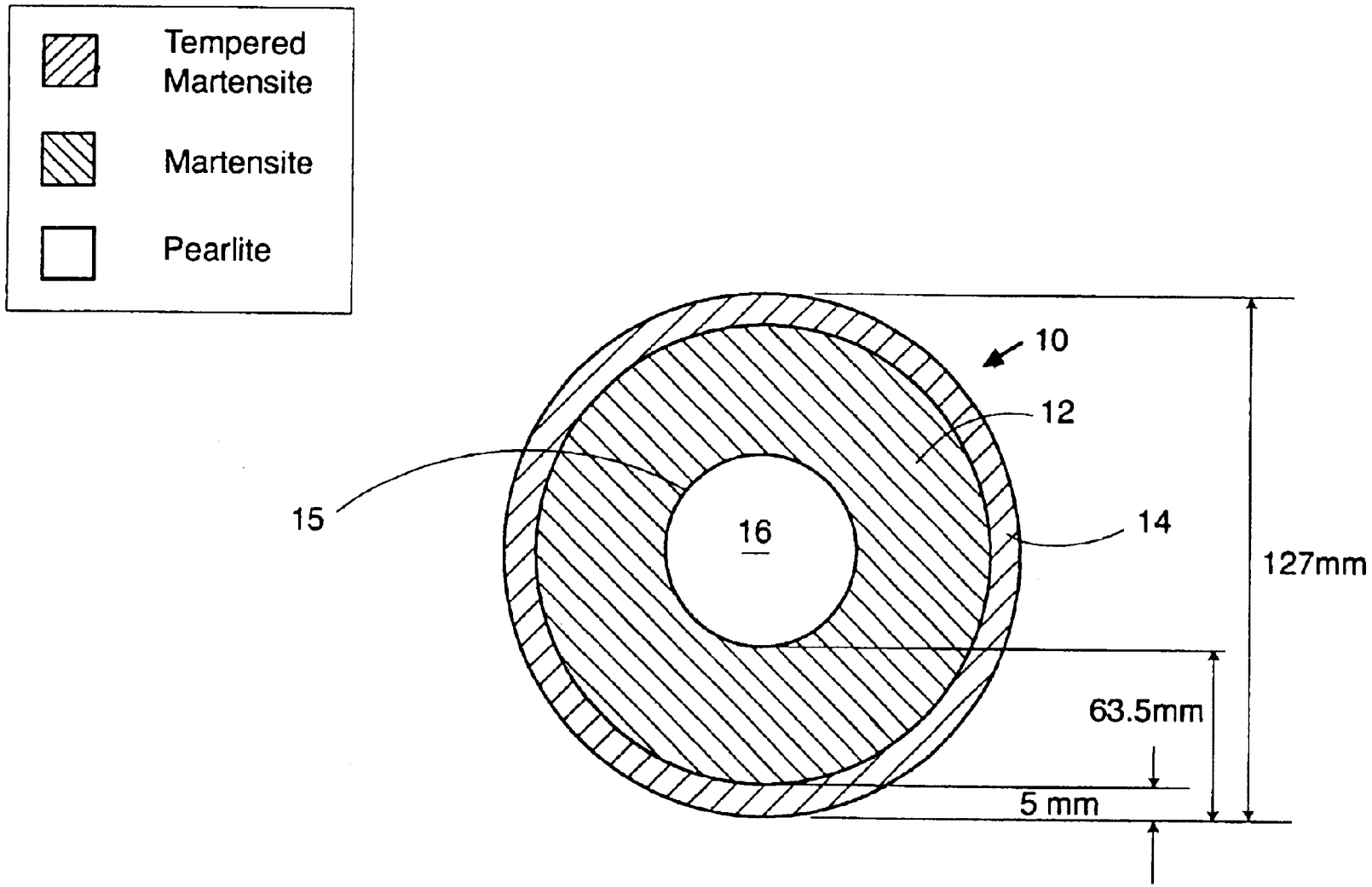
FIG. 2 is a section through a grinding ball showing a stress relieved outer shell of martensite, an intermediate layer of non-stress relieved martensite and an inner core of pearlite.

FIG. 2 graphically demonstrates the impact of stress relieving the tempered grinder ball of larger diameter in excess of 7 to 8 cm. It has been surprisingly found that the extent to which the martensitic shell, generally designated 12 of the grinder ball 10, is considerably less than what would normally be expected. As graphically demonstrated, the outer stress relieved martensitic shell 14 is normally of a thickness less than the balance of the martensitic shell 12 which is formed during the tempering of the grinder ball. When the grinder ball exits the quench step of FIG. 1, there are at least for larger balls virtually two layers, the outer very hard martensitic shell 12 and the inner pearlitic core 16. After the ball is stress relieved, the outer shell of stress relieved martensite is formed where preferably the hardness of the outer shell has not decreased or if so, to a limited extent. The stability of a partially stress relieved grinder ball is far superior to what has been expected in the past. It is not necessary to totally stress relieve the martensitic shell 12 and for that matter such an attempt to stress relieve a grinder ball to that extent would result in a significant loss of hardness. Applicant has found that, by partially stress relieving the martensitic shell, there is a sufficient reduction in the external stresses to balance, along with the pearlitic core, the stresses in the non-stress relieved martensitic shell 12. This considerably reduces the costs of heat treating grinding balls to relieve stresses and is considerably different from what was thought to be standard practice in the grinder medium field.

Figure 3:
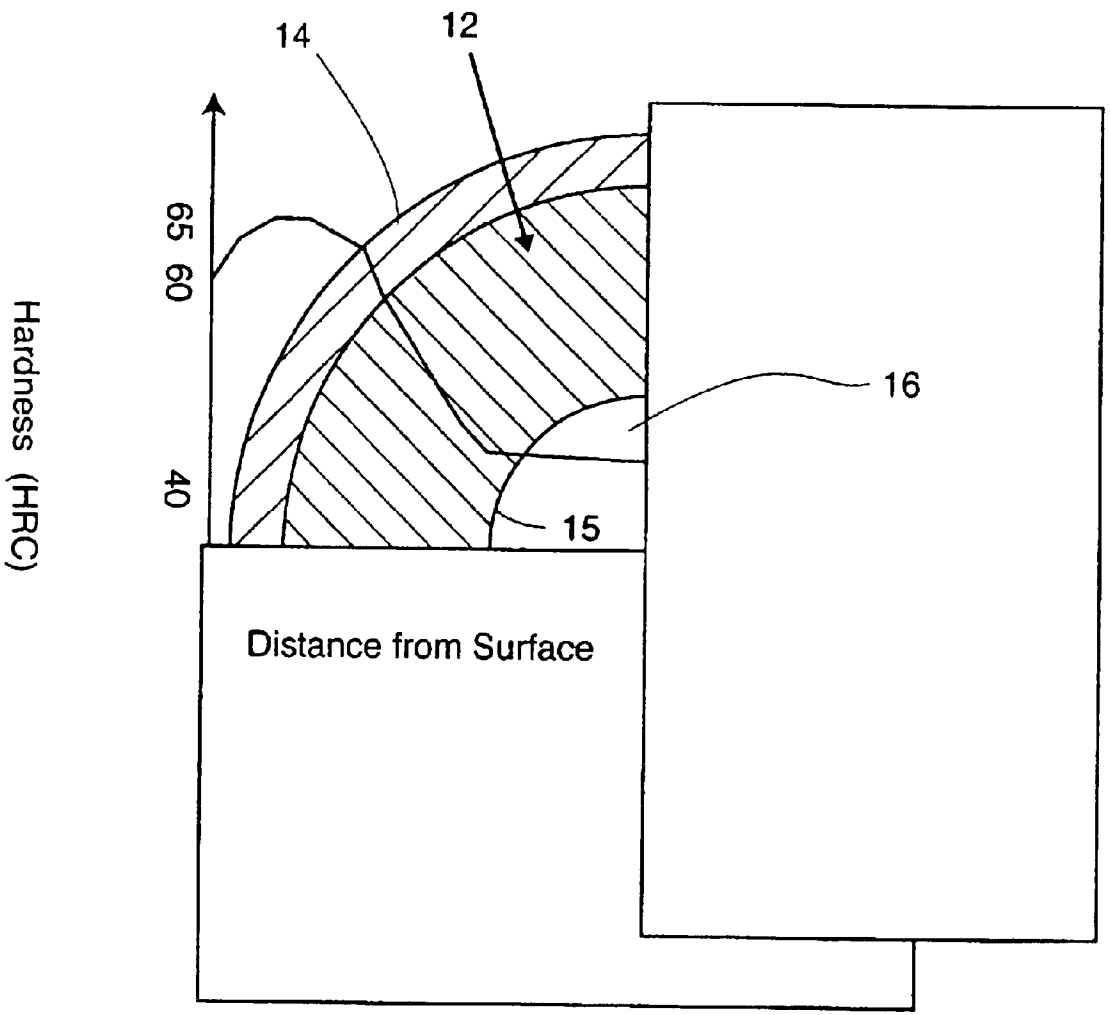
FIG. 3 is a quarter section through a grinding ball showing the change in hardness through the martensitic shells into the pearlitic core.

The extent of stress relieve for the larger ball as shown in FIG. 3 results in a very slight drop in hardness from, say about 65 in the martensitic intermediate layer 12 and the outer stress relieved layer 14. In the outer layer 14, at the very periphery, the hardness is around 63 and then slowly increases to about 65 as depth in the outer martensitic shell 14 increases and move towards the intermediate martensitic shell 12. The hardness of the intermediate martensitic shell 12 falls off towards a level of about 45 which is the hardness of the pearlitic core 16. Although FIG. 3 shows a line boundary 15, in actual fact as previously noted, the line is defined by that region about 50% by weight martensite. It is understood that there is a gradient in the transition from the martensite shell to the pearlitic core.

Figure 4:
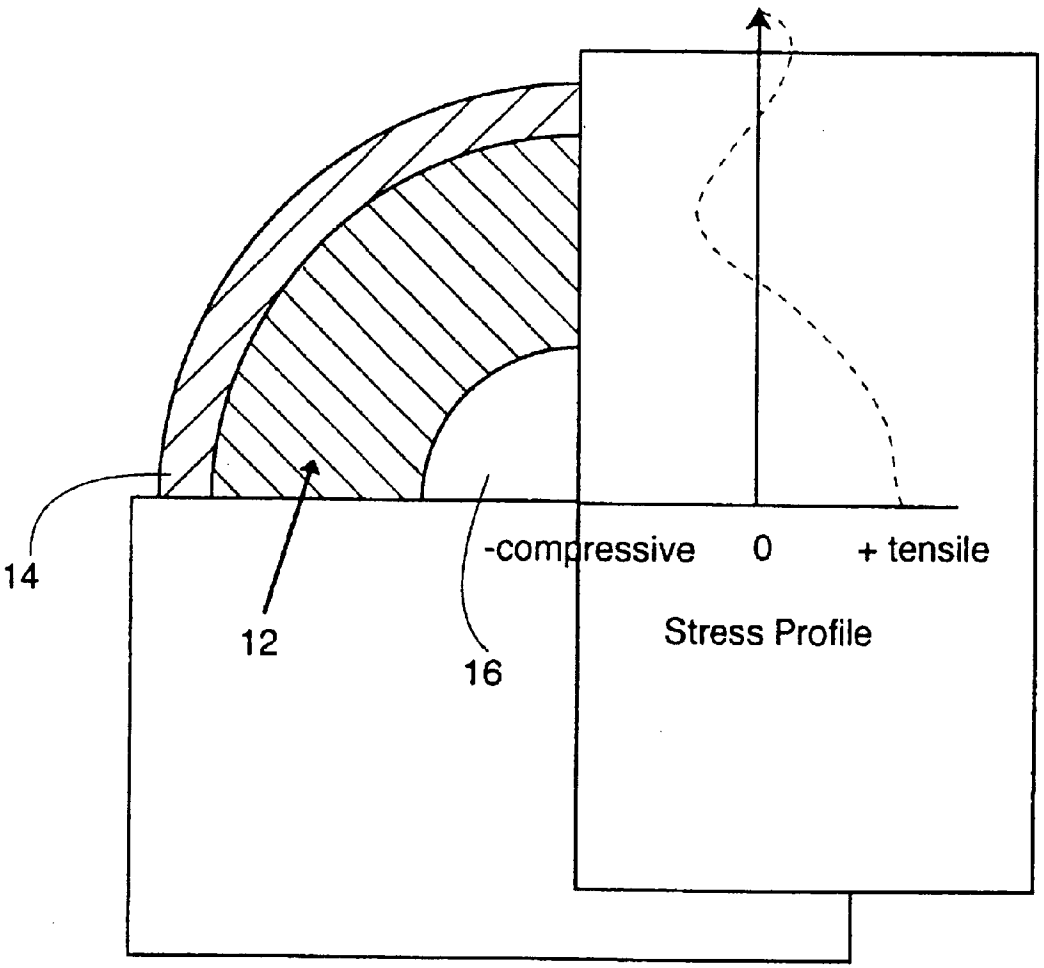
FIG. 4 is a similar section to FIG. 3 only plotting the stress profile from the pearlitic core through the martensitic shells.

With reference to FIG. 4, the balancing stresses in the larger grinder ball are shown. The inner pearlitic core 16 is under tensile stress. The intermediate martensitic shell 12 is in compression and the outer stress relieved martensitic shell 14 due to stress relieve is placed in tension. The outer shell 14 and the pearlitic core balance the compressive stresses in the martensitic shell 12 to stabilize the ball and prevent the ball from breaking apart during use in grinding environments.

It has been surprisingly found that, by partially stress relieving the martensitic shell 12, and providing the slightly softer, albeit tougher and more durable, outer shell very little if any spalling occurs. This could greatly enhance the value of such grinder balls in the marketplace, because it minimizes the amount of grinder ball pieces due to spalling which can find their way into downstream parts of the process and contaminate the ground ore.

Accordingly, the stress relieve process of this invention surprisingly provides grinder balls, regardless of large or small size, which are far more stable than the prior art alternatives. Such advantages are due to a partial stress relieve of the martensitic shell, so as to increase the toughness of the outer shell provide balancing tensile stresses for the martensitic section which is under compression and to thereby increase stability of the ball to attain longer grinder ball life.

It is appreciated that various processing parameters may change depending upon the size of the balls, the chemistry of the balls or the structure of the quench vessel.

It is appreciated that these modifications are well within the purview of those skilled in the art to achieve all of the benefits and advantages of this invention which in summary are as follows. The technique of this invention for mildly stress relieving the compressive stresses in the martensitic section provide grinding balls with superior durability particularly when used in heavy duty grinding environments. This gives the ball significant toughness characteristics when used as a grinding ball.

Although preferred embodiments of the invention have been described herein in detail, it will be understood by those skilled in the art that variations may be made thereto without departing from the spirit of the invention or the scope of the appended claims.

What is claimed is:

1. A grinding bull having a hardened outer section of tempered martensite wherein said ball has been stress relieved to stabilize said ball against break up end/or spalling by developing an outer stress relieved martensitic shell, said ball being heated to its previous equalization temperature of its earlier tempering process so as to develop an outer stress relief martensitic shell by reducing circumferential compressive stresses in said hardened outer section without appreciably reducing hardness in the outer shell.

2. A grinding ball of claim 1 wherein said martensitic shell has a hardness of 55 to 65 Rockwell C.

3. A grinding ball of claim 2, wherein said martensitic shell has a hardness of 60 to 65 Rockwell C.

4. A grinding ball of claim 1 wherein said ball has a chemistry of:

| | |
|---|---|
| carbon | .70–1.30% by weight |
| manganese | .60–1.00% by weight |
| silicon | .10–.40% by weight |
| chromium | residual levels - 1.00% by weight |
| molybdenum | residual levels - 0.5% by weight. |

5. A grinding ball of claim 1, wherein said ball is less than 8 cm in diameter and said martensitic section extends to ball core.

6. A grinding ball of claim 1 wherein said ball is greater than 8 cm in diameter and said stress relieved martensitic section reduces circumferential internal compressive stresses in the outer martensitic section and thereby stabilizes said ball against break up as caused by balancing tensile stresses in the pearlitic core exceeding the tensile strength of the core.

7. A grinding ball having a hardened section of tempered martensite wherein said ball has stress relieved to stabilize said ball against break up and/or spalling by developing an outer stress relieved martensitic shell, said ball having a chemistry of:

| | |
|---|---|
| carbon | .70–1.30% by weight |
| manganese | .60–1.00% by weight |
| silicon | .10–.40% by weight |
| chromium | residual levels - 1.00% by weight |
| molybdenum | residual levels - 0.5% by weight. |

8. A grinding ball having a hardened section of tempered martensite wherein said ball has stress relieved to stabilize said ball against break up and/or spalling by developing an outer stress relieved martensitic shell, said ball being greater than 8 cm in diameter and wherein said stress relieved martensitic section reduces circumferential internal compressive stresses in the outer martensitic section and thereby stabilizes said ball against break up as caused by balancing tensile stresses in the pearlitic core exceeding the tensile strength of the core.

* * * * *

UNITED STATES PATENT AND TRADEMARK OFFICE

CERTIFICATE OF CORRECTION

PATENT NO. : 6,802,914 B2
DATED : October 12, 2004
INVENTOR(S) : Jager

It is certified that error appears in the above-identified patent and that said Letters Patent is hereby corrected as shown below:

Column 8,
Lines 21 and 34, “wherein said ball has stress” should read -- wherein said ball bas been stress --.

Signed and Sealed this

Twenty-second Day of February, 2005

JON W. DUDAS
*Director of the United States Patent and Trademark Office*